US008055007B2

(12) United States Patent
Kim

(10) Patent No.: US 8,055,007 B2
(45) Date of Patent: Nov. 8, 2011

(54) EARPHONE HAVING VARIABLE DUCT UNIT

(75) Inventor: Jong-bae Kim, Seoul (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 1411 days.

(21) Appl. No.: 11/586,531

(22) Filed: Oct. 26, 2006

(65) Prior Publication Data

US 2007/0154050 A1 Jul. 5, 2007

(30) Foreign Application Priority Data

Dec. 29, 2005 (KR) ..... 10-2005-0133157

(51) Int. Cl.
*H04R 25/00* (2006.01)

(52) U.S. Cl. ..... 381/382; 381/372; 381/379

(58) Field of Classification Search ..... 381/370–374, 381/379–380, 382–383, 328
See application file for complete search history.

(56) References Cited

U.S. PATENT DOCUMENTS

| | | | | |
|---|---|---|---|---|
| 4,852,177 | A * | 7/1989 | Ambrose | 381/338 |
| 5,022,486 | A * | 6/1991 | Miura et al. | 381/382 |
| 7,079,664 | B2 * | 7/2006 | Nassimi | 381/380 |

FOREIGN PATENT DOCUMENTS

| | | |
|---|---|---|
| JP | 61-81283 | 5/1986 |
| JP | 07-170591 | 7/1995 |
| JP | 2000-341784 | 12/2000 |
| KR | 1990-21476 | 12/1990 |
| KR | 1991-6587 | 8/1991 |
| KR | 1993-4028 | 2/1993 |
| KR | 10-149600 | 6/1997 |
| KR | 20-124822 | 7/1997 |
| KR | 2000-58143 | 9/2000 |
| KR | 20-200161 | 10/2000 |
| KR | 2003-77735 | 10/2003 |
| KR | 20-337668 | 1/2004 |
| KR | 20-34225 | 3/2004 |
| KR | 2004-88128 | 10/2004 |

OTHER PUBLICATIONS

Korean Office Action dated Aug. 28, 2006 issued in KR 2005-133157.

* cited by examiner

*Primary Examiner* — Suhan Ni

(74) *Attorney, Agent, or Firm* — Stanzione & Kim, LLP

(57) ABSTRACT

An open-air type earphone having a duct that communicates between an inside and an outside of the earphone and applies an inductance component to an acoustic signal generated by an electroacoustic transducer. The earphone includes the electroacoustic transducer to convert an electric signal into an acoustic signal, a housing to accommodate the electroacoustic transducer, and a variable duct unit that inwardly extends from the housing to communicate between the earphone and the surrounding atmosphere, and to adjust an inductance component for the acoustic signal generated by the electroacoustic transducer. Since a length or sectional area of the duct can be varied at an end of the housing, a frequency characteristics, particularly, a loss bass characteristic of the earphone, can be easily adjusted according to a user's taste, a genre of music, and the like.

9 Claims, 8 Drawing Sheets

EARPHONE HAVING VARIABLE DUCT UNIT

CROSS-REFERENCE TO RELATED APPLICATIONS

This application claims the benefit of Korean Patent Application No. 10-2005-0133157, filed on Dec. 29, 2005, in the Korean Intellectual Property Office, the disclosure of which is incorporated herein in its entirety by reference.

BACKGROUND OF THE INVENTION

1. Field of the Invention

The present general inventive concept relates to an earphone, and more particularly, to an open-air type earphone having a duct that communicates between an inner portion of the earphone and an outer portion of the earphone and applies an inductance component to an acoustic signal generated by an electroacoustic transducer.

2. Description of the Related Art

Earphones are tiny speakers that fit into a user's ears and have an electroacoustic transducer that converts an electric signal into an acoustic signal.

Earphones can be classified as a closed-air type earphone and an open-air type earphone according to the shape of a housing in which an electroacoustic transducer is contained. Closed-air type earphones are configured such that a housing is hermetically closed from the surrounding atmosphere, and open-air type earphones are configured such that small back holes are formed along an edge of a rear portion of a housing to communicate between the inside and the outside of the housing.

In closed-air type earphones, since the sound pressure in the ear changes according to how tight the earphone fits into the ear, the sound quality can also vary. However, in the open-air type earphones, since the inside and the outside of a housing communicate with each other, the sound pressure inside the ear can be maintained constant over a wide range of frequencies from a low frequency to a high frequency. Additionally, acoustic resistance materials, e.g., urethane foams, may be embedded in back holes formed in the housing of the open-air type earphones to reduce external noise.

Resonance in the open-air type earphone occurs at a frequency between a middle frequency and a high frequency of an acoustic signal according to the size of the back holes. This resonance results in a sound pressure peak between the middle frequency and the high frequency, thereby degrading frequency characteristics of the open-air type earphones. In an effort to address these problems, U.S. Pat. No. 4,742,887 describes an open-air type earphone having a duct.

FIG. 1 is a cross-sectional view illustrating a conventional open-air type earphone.

Referring to FIG. 1, the conventional open-air type earphone includes an electroacoustic transducer 102 including a permanent magnet, a voice coil, and a diaphragm, and a housing 104 accommodating the electroacoustic transducer 102. Back holes 106 are formed in the back of the housing 104 and are covered by acoustic resistance materials such as nonwoven fabrics. A duct 108 extends from a side of the housing 104.

In the conventional open-air type earphone having the back holes 106, since the frequency response decreases at frequencies below the resonant frequency of the vibration system consisting of the voice coil and the diaphragm, the resonant frequency of the electroacoustic transducer 102 should be as small as possible in order to improve the low frequency characteristic.

The resonant frequency of the electroacoustic transducer 102 may be decreased by increasing the compliance or the equivalent mass of the electroacoustic transducer 102. Here, the compliance is a measure of the flexibility of a moving body. For example, a high compliance speaker is very soft at a cone support portion.

In particular, in order to increase the compliance of the electroacoustic transducer 102, it is necessary to either (1) select a material of high compliance for the diaphragm or (2) decrease the thickness of the diaphragm. However, there are limits regarding the compliance of the material that can be used for the diaphragm and the extent to which the thickness of the diaphragm can be reduced. Further, by increasing the equivalent mass of the electroacoustic transducer 102, the sensitivity and acoustic characteristic of the earphone in the high frequency range is deteriorated.

In the conventional open-air type earphone of FIG. 1, the compliance and the equivalent mass of the electroacoustic transducer 102 are improved by extending a portion of the housing 104 to form the duct 108. Since the duct 108 adds an equivalent mass to the vibration system, the resonant frequency of the vibration system is reduced by the amount corresponding to the added equivalent mass. That is, this reduction of the resonant frequency of the vibration system is achieved irrespective of the compliance and the equivalent mass of the vibration system. Accordingly, the low frequency characteristic of the conventional open-air type earphone can be improved due to the duct 108.

The low frequency characteristic of the earphone is basically determined by the equivalent mass of the duct 108 and the resonant frequency of the vibration system, but also is determined by how tight the earphone fits in the ear. That is, the low frequency characteristic is changed according to the leakage of sound when an acoustic signal generated by the earphone is transmitted to the ear. The low frequency component of the acoustic signal is reduced when there is a great deal of sound leakage.

Additionally, since the hearing sensitivity of different users varies based on ear structure, the low frequency characteristic of the earphone is also affected by the ear structure as well as the equivalent mass of the duct 108 and the resonant frequency of the vibration system.

Users may also want to adjust the low frequency characteristic of the earphone according to the music genre. Here, the low frequency ranges from 20 to 200 Hz, and can be divided into deep bass ranging from 20 to 40 Hz, middle bass ranging from 40 to 400 Hz, and upper bass ranging from 100 to 200 Hz. For example, deep bass is particularly important when listening to classical music, whereas upper bass is particularly important when listening to hip-hop or dance music.

Accordingly, the low frequency characteristic should be adjusted according to a user's physical feature (i.e., the ear structure), taste, and music genre.

SUMMARY OF THE INVENTION

The present general inventive concept provides an open-air type earphone having a low frequency characteristic which can be adjusted according to a user's physical feature, taste, and a genre of music.

Additional aspects of the present general inventive concept will be set forth in part in the description which follows and, in part, will be obvious from the description, or may be learned by practice of the general inventive concept.

The foregoing and/or other aspects of the present general inventive concept are achieved by providing an earphone including an electroacoustic transducer to convert an electric signal into an acoustic signal, a housing to accommodate the electroacoustic transducer therein, and a variable duct unit that extends inwardly from the housing to communicate between the transducer and a surrounding atmosphere, and to adjust an inductance component for the acoustic signal generated by the electroacoustic transducer.

The variable duct unit may include an extended portion extending from a side of the housing, and a duct mounted in the extended portion and sliding in a longitudinal direction of the housing.

The variable duct unit may include an extended portion extending from a side of the housing, a plurality of sub ducts mounted in the extended portion, and an opening unit to open and close one or more of the plurality of sub ducts.

The foregoing and/or other aspects of the present general inventive concept are achieved by providing an earphone, including a rounded housing having a transducer disposed therein, an extended portion extending away from a side of the housing, and a duct disposed in the extended portion and having at least one of an adjustable cross sectional area and an adjustable length.

The foregoing and/or other aspects of the present general inventive concept are achieved by providing an earphone, including a circular housing having a first side with a speaker unit and a second side having back holes extending therethrough, an elongated portion extending from a rounded side of the housing, and a movable duct disposed in the elongated portion and which is movable between at least first and second positions with respect to the housing such that a frequency characteristic is adjustable by moving the duct.

BRIEF DESCRIPTION OF THE DRAWINGS

These and/or other aspects of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
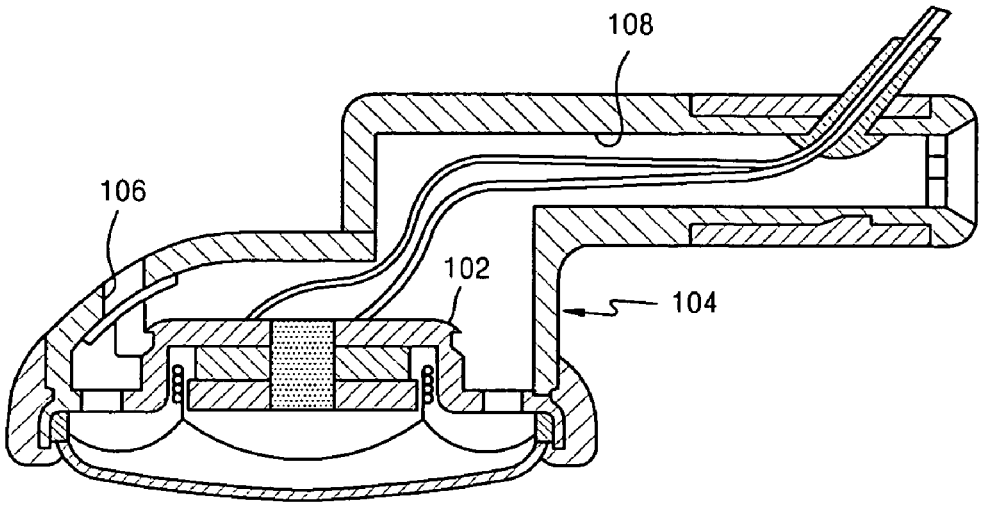
FIG. 1 (PRIOR ART)
FIG. 1 is a cross-sectional view illustrating a conventional open-air type earphone.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
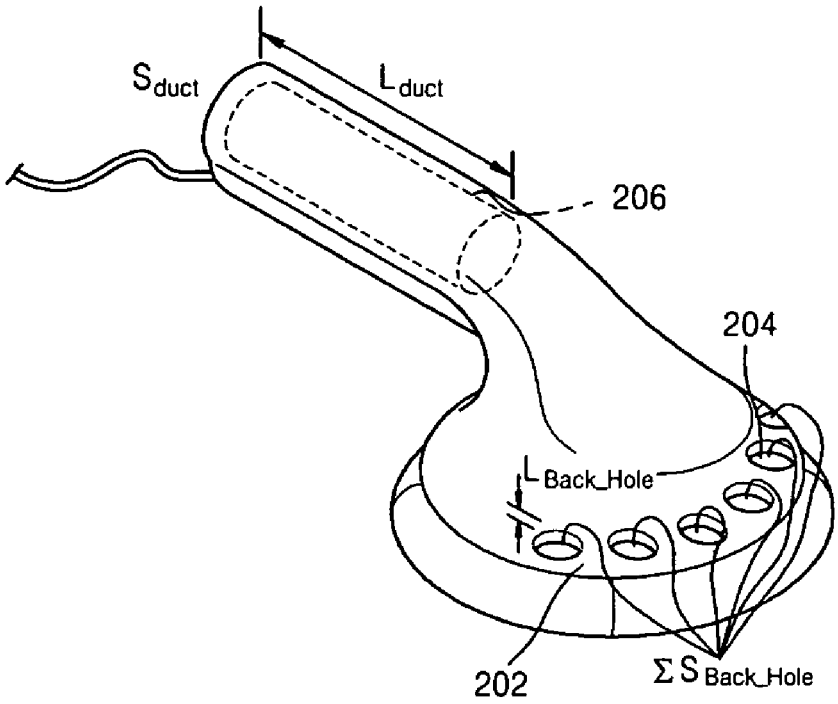
FIG. 2 is a perspective view illustrating an open-air type earphone.

FIG. 2 is a perspective view illustrating an open-air type earphone.

Referring to FIG. 2, the open-air type earphone includes a housing 202 having back holes 204 with a predetermined length $L_{Back_Hole}$ and a gross sectional area $\Sigma S_{Back_Hole}$ formed therein, and a duct 206 having a predetermined sectional area $S_{duct}$ and a predetermined length $L_{duct}$ contained therein.

Figure 3:
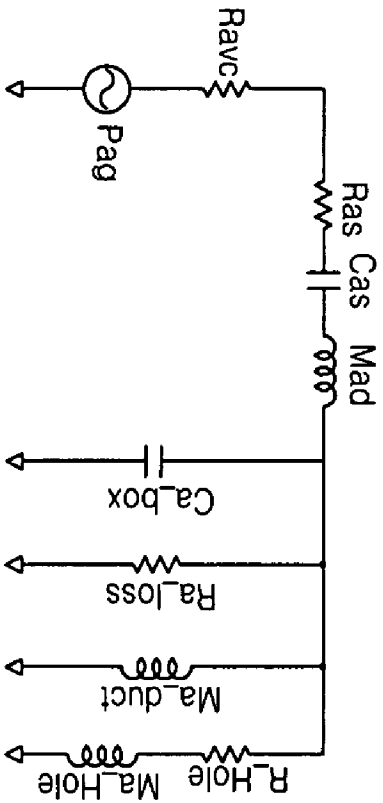
FIG. 3 is a circuit diagram illustrating an acoustic analytic model of the open-air type earphone of FIG. 2.

FIG. 3 is a circuit diagram illustrating an acoustic analytic model of the open-air type earphone of FIG. 2.

Referring to FIG. 3, subscript "a" represents an acoustic parameter, "Ca_box" represents a capacitance of the housing 202, "Ma_duct" represents an inductance of the duct 206, "Ra_loss" represents a sum of resistances of the housing 202, the duct 206, and other serial components, "R_Hole" represents air-flow resistance of materials, for example, nonwoven fabrics, covering the back holes 204, and "Ma_Hole" represents an inductance of the back holes 204.

These variables are calculated as follows.

$Ca_\text{box}=V_{box}/\rho\cdot c^2$ $Ma_\text{duct}=\rho\cdot c^2/S_{duct}$

R_Hole; value obtained by measurement $Ma_\text{Hole}=\rho\cdot L_{Back_Hole}/\Sigma S_{Back_Hole}$ where "$V_{box}$" represents a volume of the housing 202, "ρ" represents an air density, "c" represents a sound velocity in air (345 m/s), "Ravc" represents a resistance of a voice coil, "Ras" represents a suspension resistance, "Cas" represents a suspension compliance, and "Mad" represents a mass of a diaphragm.

These variables can be obtained by Thiele & Small Parameter as follows.

$i=Eg/Revc$; current in voice coil $F=BL\cdot I=Eg\cdot BL/Revc\cdot Sd$; force generated by coil $Pag=F/Sd=Eg\cdot BL/Revc\cdot Sd$; pressure generated by diaphragm $$R_{avc} = \frac{1}{R_{evc}} \cdot \left(\frac{BL}{Sd}\right)^2;$$

resistance of voice coil $Mad=Mmd/Sd^2$; mass of diaphragm $Mas(\omega)=Mad+Mar(\omega)$; diaphragm mass plus radiation mass $Mas_=Mad+Mar_$; approximate value of $Mas(\omega)$ $Cas=Cms\cdot Sd^2$; suspension compliance $$Ras = \frac{Rms}{Sd^2} \cong \frac{\sqrt{Mas(0)/Cas}}{Qms};$$

suspension resistance

As mentioned above, the Ra_loss is the sum of the resistances of the housing 202, the duct 206, and other serial components, and is given by:

$$\text{Ra_loss} = \frac{Q_{loss}}{w_{box} \cdot \text{Ca_box}}$$

where "$Q_{loss}$" represents a total box loss of the housing 202, and ranges from 3 to 7 according to the damping degree of the housing 202, and "$\omega_{Box}$" represents a resonant frequency 2*π* of the duct 206.

Figure 4:
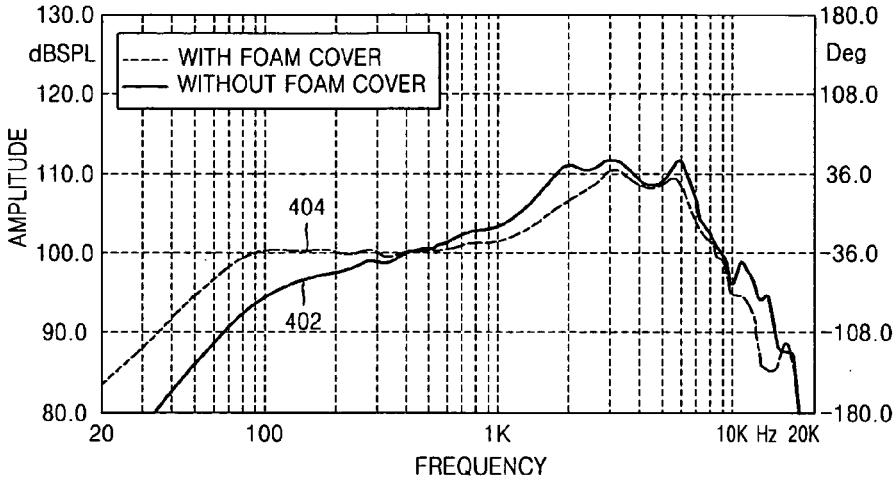
FIG. 4 is a graph illustrating response characteristics when the open-air type earphone of FIG. 2 includes a foam cover versus when the open-air type earphone does not include the foam cover.
Figure 5:
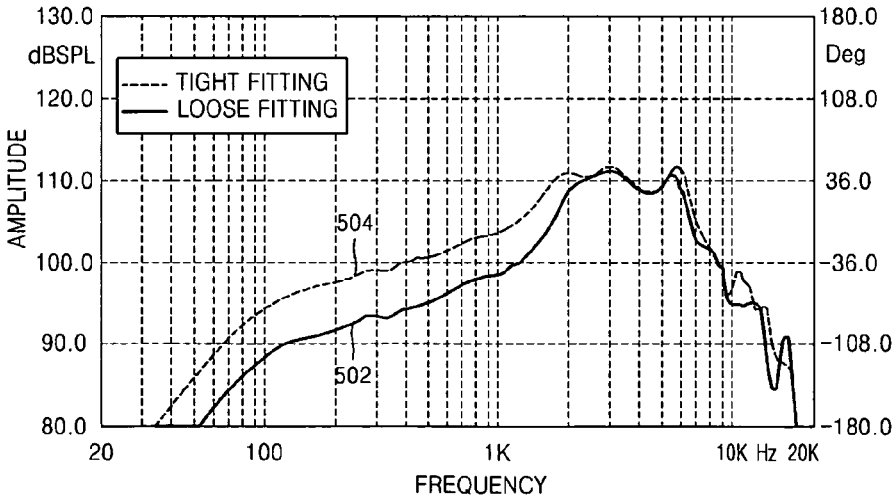
FIG. 5 is a graph illustrating response characteristics when the open-air type earphone of FIG. 2 fits in the ear tightly versus when the open-air type earphone fits into the ear loosely.

FIG. 4 is a graph illustrating response characteristics when the open-air type earphone of FIG. 2 includes a foam cover versus when the open-air type earphone of FIG. 2 does not include the foam cover. FIG. 5 is a graph illustrating frequency response characteristics when the open-air type earphone of FIG. 2 fits in the ear tightly versus when the open-air type earphone of FIG. 2 fits loosely in the ear. The foam cover may be an earphone cover made of sponge used to increase tightness between the open-air type earphone of FIG. 2 and the ear. The graph of FIG. 4 illustrates the frequency response characteristics of the open-air type earphone of FIG. 2 measured using a head and torso system.

A curve 402 indicated by a thick solid line in FIG. 4 illustrates the frequency response characteristic when the open-air type earphone of FIG. 2 does not include the foam cover, and a curve 404 indicated by a thin dashed line in FIG. 4 illustrates the frequency response characteristic when the open-air type earphone of FIG. 2 includes the foam cover.

A curve 502 indicated by a thick solid line in FIG. 5 illustrates the frequency response characteristic when the open-air type earphone of FIG. 2 fits in the ear loosely. A curve 504 indicated by a thin dashed line in FIG. 5 illustrates the frequency response characteristic when the open-air type earphone of FIG. 2 fits in the ear tightly.

Referring to FIGS. 4 and 5, the low frequency characteristic of the open-air type earphone varies substantially with the presence of the foam cover and how tightly the earphone fits in the ear, as compared with other frequency characteristics.

In other words, the frequency response characteristic is changed according to the state of the earphone and a condition in which the earphone is used. Accordingly, a user should adjust the low frequency characteristic according to the state of the earphone, a condition in which the earphone is used, and the genre of music being reproduced.

Referring back to FIG. 2, the open-air type earphone according to embodiments of the present general inventive concept enables a user to adjust a low frequency characteristic according to the state of the earphone, a condition in which the earphone is used, a user taste or preference, or music being listened to by varying the length $L_{duct}$ and the sectional area $S_{duct}$ of the duct 206 installed in the housing 202.

Figure 6:
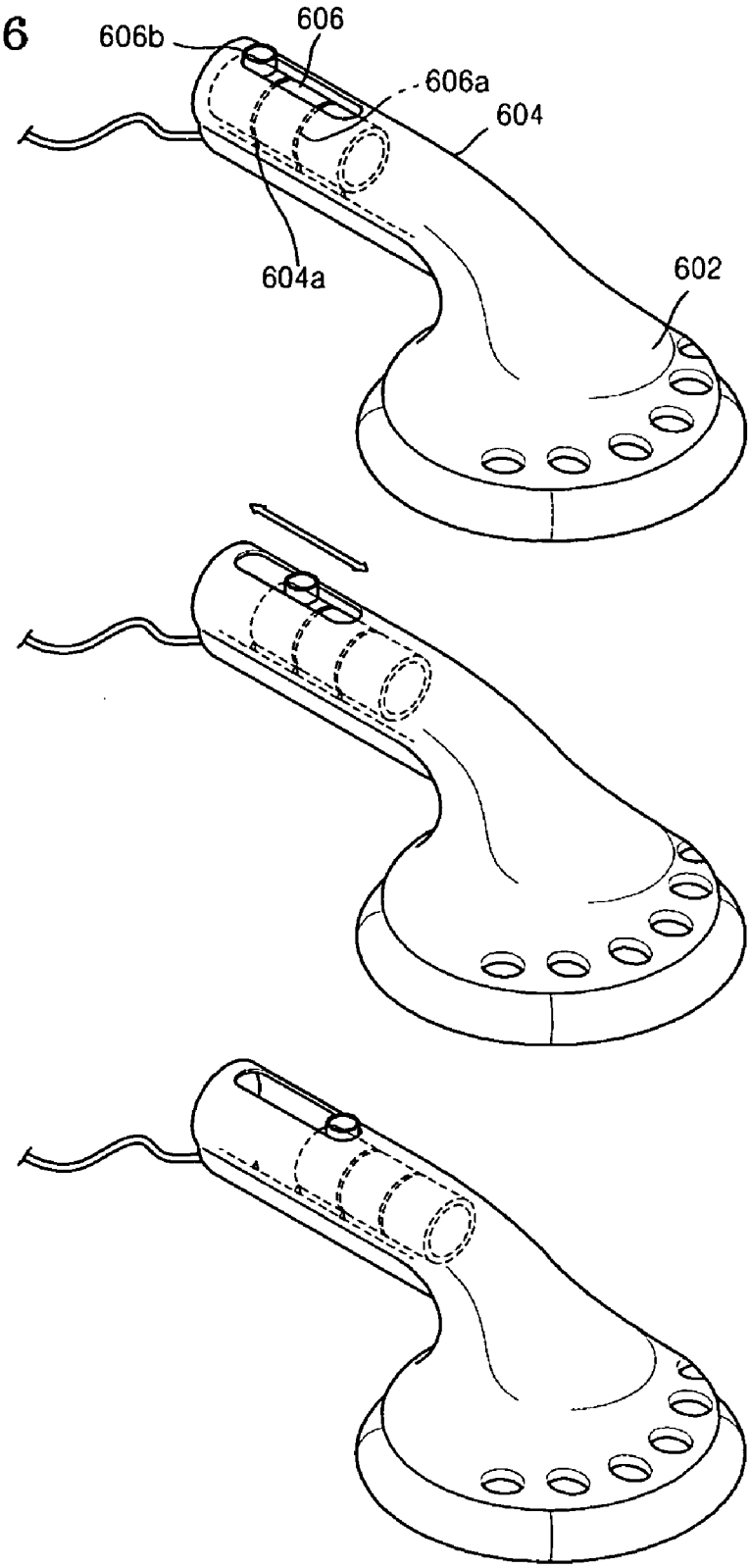
FIG. 6 is a perspective view illustrating an earphone according to an embodiment of the present general inventive concept having a distance between a duct and a housing that is adjustable.

FIG. 6 is a perspective view illustrating an earphone according to an embodiment of the present general inventive concept. FIG. 6 illustrates cases in which a distance between a housing 602 and a duct 606 is adjusted. Referring to FIG. 6, an extended portion 604 extends from a side of the housing 602 in a longitudinal direction. The extended portion 604 contains the duct 606. The duct 606 can be moved inside the extended portion 604 in the longitudinal direction. The duct 606 has a predetermined length and has a first hole formed toward the housing 602 and a second hole formed perpendicular to the longitudinal direction. An inside and outside of the housing 602 communicate with each other through the first and second holes.

Fixing grooves 606*a* are formed at constant intervals on an outer surface of the duct 606. Fixing protrusions 604*a* are formed on an inner surface of the extended portion 604 to correspond to and engage the fixing grooves 606*a* of the duct 606. The duct 606 can be fixed by the fixing grooves 606*a* and the fixing protrusions 604*a*.

The duct 606 has a projection 606*b* which has the second hole. The projection 606*b* projects from a surface of the extended portion 604 through an opening of the extended portion 604 such that a user can easily move the duct 606 by hand. A lower side of the duct 606 is closed and thus the duct 606 communicates with the surrounding atmosphere through the second hole.

Referring to FIG. 6, the duct 606 can be adjusted to three positions. A distance between the duct 606 and the housing 602 is changed according to the positions of the duct 606. For example, upper, middle, and lower perspective views of FIG. 6 illustrate cases in which the distance between the protrusion 606*b* of the duct 606 and a portion of the housing 602 where the housing 602 meets the extended portion 604 is adjusted to 12 mm, 8 mm, and 4 mm, respectively. The distances are measured from a free end of the protrusion 606*b* via the inside of the duct 606 to the portion of the housing 602 where the housing 602 meets the extended portion 604.

Figure 7:
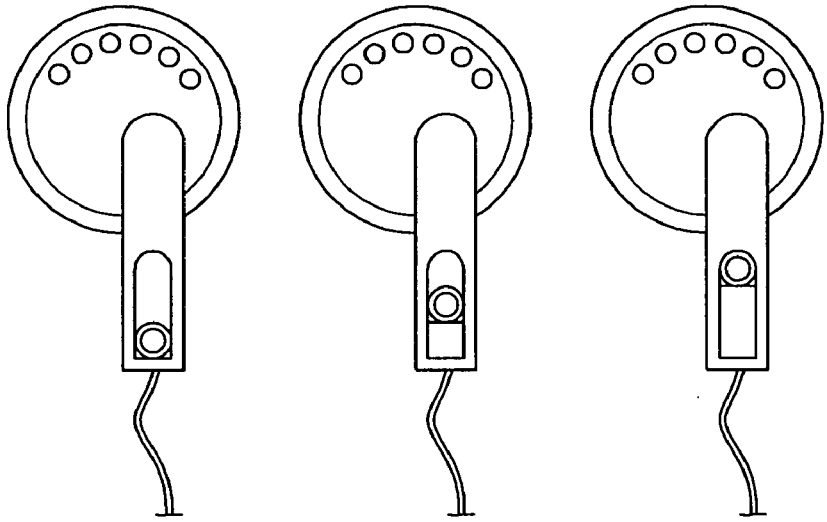
FIG. 7 is a plan view illustrating the earphone of FIG. 6.

FIG. 7 is a plan view illustrating the earphone of FIG. 6. Left, middle, and right plan views of FIG. 7 correspond to the upper, middle, and lower perspective views of FIG. 6, respectively.

Referring to FIGS. 6 and 7, a frequency characteristic of the earphone is changed by adjusting the distance between the duct 606 and the housing 602.

Figure 8:
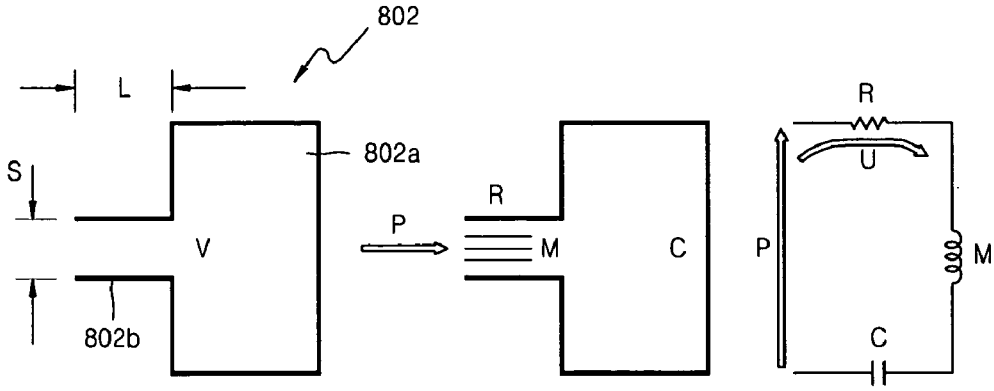
FIG. 8 illustrates a Helmholtz resonator model, an acoustic model, and an analogous circuit of an open-air type earphone.

FIG. 8 illustrates a Helmholtz resonator model, an acoustic model, and an analogous circuit of the earphone of FIG. 6. The open-air type earphone can be modelled as a Helmholtz resonator 802 (left) as illustrated in FIG. 8.

The Helmholtz resonator 802 of FIG. 8 includes a box 802*a* having a volume V, and a duct 802*b* having a length L and a sectional area S, the duct 802*b* being connected to the box 802*a*. The box 802*a* of the Helmholtz resonator 802 corresponds to the housing 602 of the open-air type earphone, and the duct 802*b* corresponds to the duct 606 of the open-air type earphone.

The Helmholtz resonator 802 may be represented as an acoustic model (middle) and an acoustic analogous circuit (right) having an acoustic impedance Z (that is, a resistance R, an inductance M, and a capacitance C). Referring to FIG. 8, "P" represents sound pressure input to the Helmholtz resonator 802, and "U" represents volume velocity in the Helmholtz resonator 802.

$$Z = \frac{P}{U} = R + j\omega \cdot M + \frac{1}{j\omega \cdot C}$$

where $$M = \frac{\rho \cdot L'}{S},\ C = \frac{V}{\rho \cdot c^2},$$

and L' is an effective length and is increased by an effect of air radiation and mass loading.

$L' = L + 0.85 \cdot d$; with flange at inlet of duct $L' = L + 0.725 \cdot d$; without flange at inlet of duct, where "d" represents a diameter of the duct 802*b*.

That is, when the sectional area S of the duct 802*b* increases or the length L of the duct 802*b* decreases, the inductance M of the Helmholtz resonator 802 decreases, and vice versa. That is, the frequency characteristic of the open-air type earphone can be adjusted by adjusting the sectional area S and the length L of the duct 802*b*.

Figure 9:
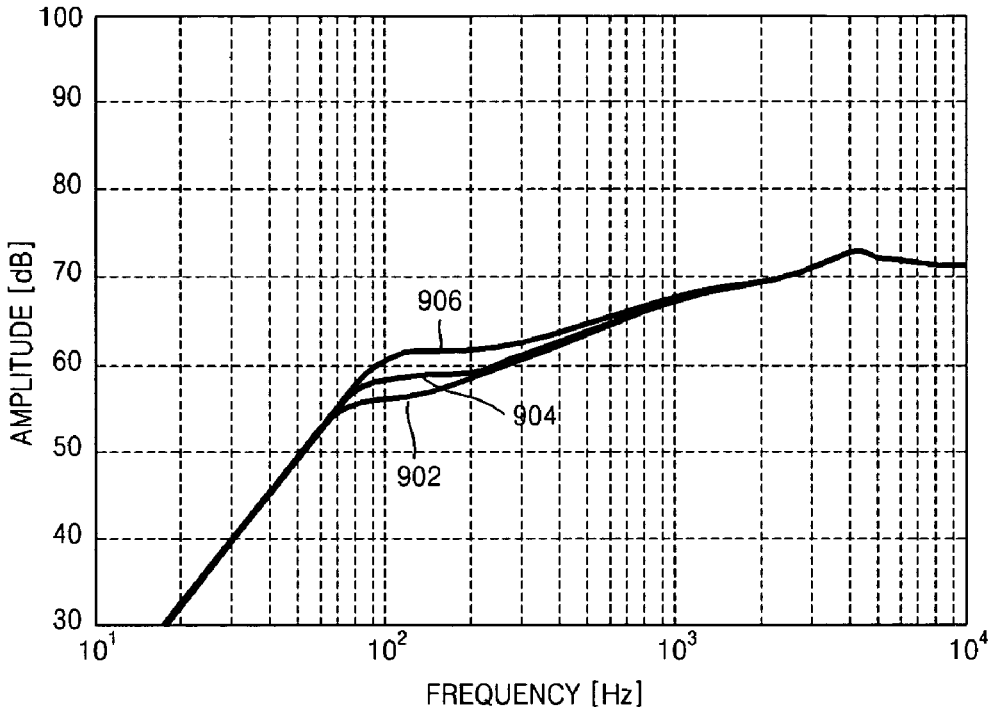
FIG. 9 is a graph illustrating frequency characteristics corresponding to the states in which the distance between the duct and the housing of the earphone is adjusted as illustrated in FIG. 6.

FIG. 9 is a graph illustrating the frequency characteristics when the distance between the duct 606 and the housing 602 is adjusted as illustrated in FIG. 6. In particular, FIG. 9 illustrates the frequency response characteristics when the earphone is mounted in an infinite baffle.

Referring to FIG. 9, curves 902, 904, and 906 correspond to the upper, middle, and lower perspective views of FIG. 6, respectively, which illustrate the states in which the distance between the duct 606 and the housing 602 are adjusted to 12 mm, 8 mm, and 4 mm. The distance may be measured between a proximal end of the duct 606 and a portion of the housing 602 where the housing 602 meets the extended portion 604. The curve 906 is suitable for hip-hop, dance music, or the like, which uses strong bits, and the curve 902 is suitable for big classic, Rock, Jazz, or the like, which requires deep bass rather than strong bass.

Referring to FIG. 9, the frequency characteristic, particularly, the low frequency characteristic of the earphone is significantly changed by adjusting the distance between the duct 606 and the housing 602.

Figure 10:
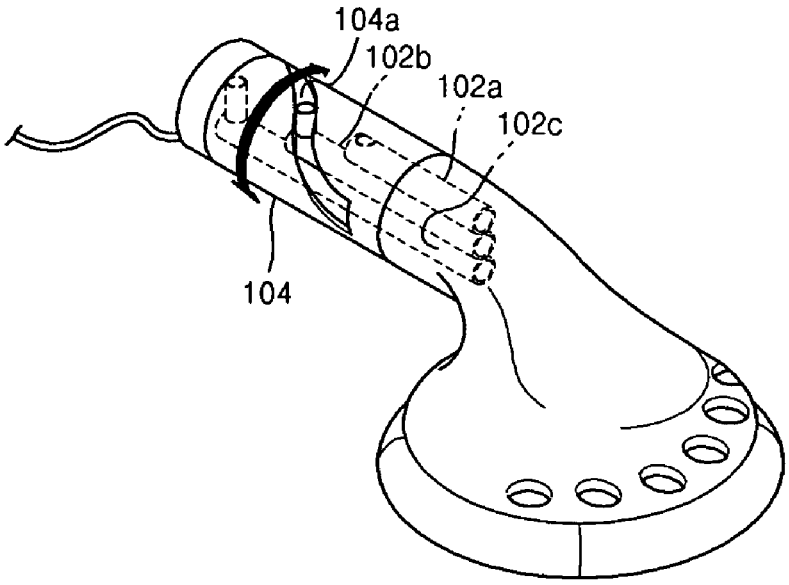
FIG. 10 is a perspective view illustrating an earphone according to another embodiment of the present general inventive concept.

FIG. 10 is a perspective view illustrating an earphone according to another embodiment of the present general inventive concept. Referring to FIG. 10, the earphone includes three fixed sub ducts 102*a*, 102*b*, and 102*c* having different lengths, and holes of the sub ducts 102*a*, 102*b*, and 102*c* are opened and closed using a moving slit 104*a*.

Figure 11:
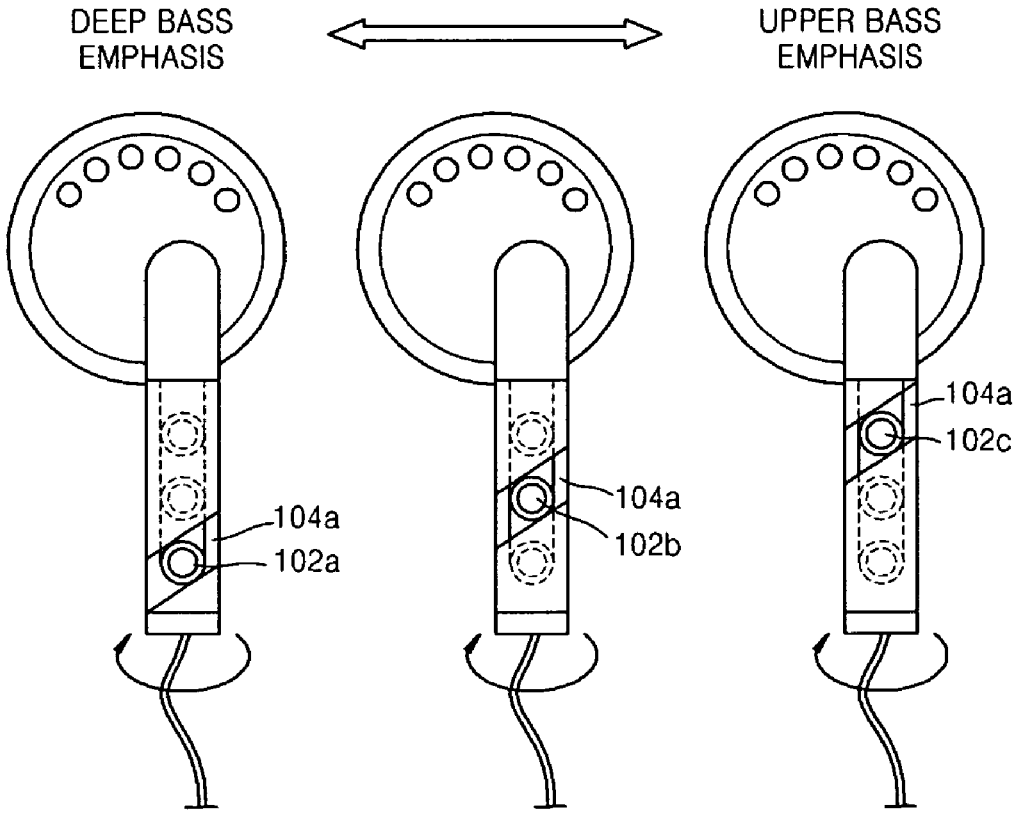
FIG. 11 is a plan view illustrating the earphone of FIG. 10 having sub ducts that are selectable using a moving slit.

FIG. 11 is a plan view illustrating the earphone of FIG. 10 when one of the sub ducts 102*a*, 102*b*, and 102*c* is selected using the moving slit 104*a*. The moving slit 104*a* is formed on a rotating grip 104, and one of the sub ducts 102*a*, 102*b*, and 102*c* can be selected by rotating the rotating grip 104. As can be seen from FIG. 11, the moving slit 104*a* can be positioned to correspond to the sub duct 102*a* to adjust deep bass frequency characteristics, the sub duct 102*b* to adjust middle bass frequency characteristics, and the sub duct 102*c* to adjust upper bass frequency characteristics. Therefore, the deep bass, middle bass and upper bass frequency characteristics can be emphasized by the positions of the moving slit 104*a*.

Figure 12:
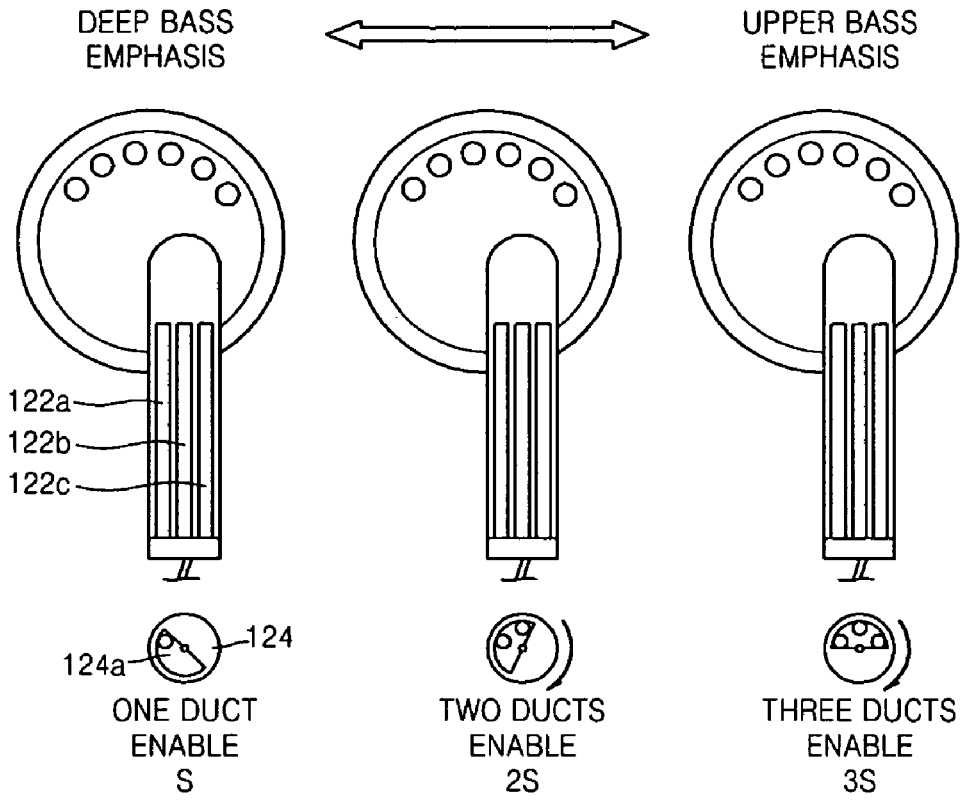
FIG. 12 is a plan view illustrating an earphone according to yet another embodiment of the present general inventive concept.

FIG. 12 is a plan view illustrating an earphone according to yet another embodiment of the present general inventive concept. Referring to FIG. 12, the earphone includes three sub ducts 122*a*, 122*b*, and 122*c* having the same length, and a rotating cover 124 having a slit 124*a* that opens and closes the sub ducts 122*a*, 122*b*, and 122*c*. A combination of the sub ducts 122*a*, 122*b*, and 122*c* can be selected by rotating the rotating cover 124. That is, a number of the sub ducts 122*a*, 122*b*, and 122*c* can be opened/closed by rotating the rotating cover 124. Accordingly, air can be moved between a housing and the number of sub ducts 122*a*, 122*b*, and 122*c*, thereby adjusting the frequency characteristics of the earphone. As can be seen from FIG. 12, the rotating cover 124 can be moved to position the slit 124*a* to correspond to one sub duct to adjust deep bass frequency characteristics, two sub ducts to adjust middle bass frequency characteristics, and three sub ducts to adjust upper bass frequency characteristics.

As described above, since a duct extends from a side of the housing and a length and sectional area of the duct can be varied, a frequency characteristic, particularly, a low frequency characteristic, of an open-air type earphone of embodiments of the present general inventive concept can be easily adjusted according to a user's taste, a genre of music, a presence of the foam cover, or a distance between the earphone and an ear of a user.

Since an acoustic inductance can be changed using mechanical elements, a frequency characteristic of an open-air type earphone of embodiments of the present general inventive concept can be adjusted simply and efficiently.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An earphone, comprising:

a rounded housing having a transducer disposed therein;

an extended portion extending away from a side of the housing; and a duct disposed in the extended portion and having at least one of an adjustable cross sectional area and an adjustable length, wherein an inside and outside of the rounded housing communicate with each other through the duct.

2. The earphone of claim 1, further comprising:

a plurality of back holes disposed in a rear side of the housing opposite to a front side of the housing.

3. The earphone of claim 2, wherein the back holes include a foam cover inserted therein.

4. The earphone of claim 1, wherein:

the extended portion includes an elongated hole disposed in a surface thereof; and the duct includes a projection extending through the elongated hole such that the duct is slidably disposed in the extended portion.

5. The earphone of claim 1, wherein:

the duct includes a plurality of sub-ducts having different lengths; and the extended portion includes a movable slit disposed in a surface of the extended portion that is movable between a plurality of different positions corresponding to the plurality of sub-ducts.

6. The earphone of claim 5, wherein each of the sub-ducts has an L-shape with a first portion extending along a direction that is parallel to a major axis of the extended portion and a second portion extending toward the surface of the extended portion perpendicular to the major axis of the extended portion.

7. The earphone of claim 1, wherein the duct comprises:

a plurality of sub-ducts extending along the extended portion; and a rotating cover disposed in a plane that is perpendicular to a major axis of the extended portion and having a blocking portion to block a first one or more of the sub-ducts and a passing portion to enable a second one or more of the sub-ducts to pass air to and from the housing.

8. The earphone of claim 1, wherein the length of the duct is adjustable by sliding the duct in the extended portion to vary a distance between an end of the duct and an entrance to the housing.

9. The earphone of claim 8, wherein the distance between the end of the duct and the housing is variable to at least one of 12 mm, 8 mm, and 4 mm.

* * * * *